US006972747B2

(12) United States Patent
Bayot et al.

(10) Patent No.: US 6,972,747 B2
(45) Date of Patent: Dec. 6, 2005

(54) METHOD FOR COMPENSATING A PERTURBED CAPACITIVE CIRCUIT AND APPLICATION TO MATRIX DISPLAY DEVICE

(75) Inventors: Jean-Marc Bayot, La Buisse (FR); Hugues Lebrun, Coublevie (FR)

(73) Assignee: Thales Avionics LCD S.A., Paris (FR)

( * ) Notice: Subject to any disclaimer, the term of this patent is extended or adjusted under 35 U.S.C. 154(b) by 336 days.

(21) Appl. No.: 10/204,313

(22) PCT Filed: Feb. 23, 2001

(86) PCT No.: PCT/FR01/00539

§ 371 (c)(1),
(2), (4) Date: Aug. 21, 2002

(87) PCT Pub. No.: WO01/65532

PCT Pub. Date: Sep. 7, 2001

(65) Prior Publication Data

US 2003/0030630 A1 Feb. 13, 2003

(30) Foreign Application Priority Data

Feb. 25, 2000 (FR) ..... 00 02410

(51) Int. Cl.[7] ..... G09G 3/36; G09G 3/20

(52) U.S. Cl. ..... 345/98; 345/55; 345/100; 345/103; 345/104

(58) Field of Search ..... 345/63, 67, 84–87, 345/92–104, 50, 51, 55, 59, 68

(56) References Cited

U.S. PATENT DOCUMENTS

| | | | | |
|---|---|---|---|---|
| 5,600,345 | A * | 2/1997 | Dingwall et al. | 345/100 |
| 5,606,194 | A | 2/1997 | Lebrun et al. | 257/433 |
| 5,841,410 | A * | 11/1998 | Oda et al. | 345/58 |
| 6,064,713 | A | 5/2000 | Lebrun et al. | 377/67 |
| 6,359,608 | B1 | 3/2002 | Lebrun et al. | 345/100 |
| 6,359,967 | B1 * | 3/2002 | Bielski et al. | 378/98.8 |
| 6,611,311 | B1 * | 8/2003 | Kretz et al. | 349/143 |

FOREIGN PATENT DOCUMENTS

FR 2 542 896 9/1984

* cited by examiner

*Primary Examiner*—Vijay Shankar
(74) *Attorney, Agent, or Firm*—Oblon, Spivak, McClelland, Maier & Neustadt, P.C.

(57) ABSTRACT

A process for compensating a circuit including at least one first conductor with a specified potential, at least one second conductor generating disturbances on the first conductor by capacitive coupling, and a first bus with a reference voltage, coupled capacitively to the first conductor. The process includes the following steps: measuring of the current flowing on the first bus upon the application of a voltage to the second conductor; integrating a measured current to obtain a compensation voltage to be applied to the first conductor; and applying the compensation voltage to at least one of the rows via the compensation conductor bus, the compensation bus coupled capacitively to the rows.

9 Claims, 2 Drawing Sheets

METHOD FOR COMPENSATING A PERTURBED CAPACITIVE CIRCUIT AND APPLICATION TO MATRIX DISPLAY DEVICE

BACKGROUND OF THE INVENTION

The present invention relates to an improvement to the process for compensating a disturbed capacitive circuit. It relates more especially to a process for compensating for the capacitive disturbances in a matrix display screen.

The present invention also relates to the application of this process to matrix display screens, more especially to display screens of the active matrix type. It therefore relates to a device for compensation of potential for a display screen controlled by an array of electrodes disposed in rows and columns. It is more especially involved with active matrix liquid crystal screens, but other screens of the same type may also be used such as LCOS screens or screens operating on the same principle.

To facilitate the description, the present invention will be described while referring to a display screen of the active matrix LCD or liquid crystal screen type. However, it may also be applied to any disturbed capacitive system which requires compensation, the latter being carried out without appending any specific measurement line, but by using a conductor plane such as the counter electrode of an active matrix LCD screen, already present by design in the capacitive system.

In the case of a display screen of the active matrix liquid crystal screen type, the latter consists, in a known manner, of a set of parallel rows and of a set of parallel columns disposed perpendicularly to one another to which are linked image-elements or pixels by way of a switching means such as a TFT transistor. This type of screen can operate sequentially, the rows being activated one after another while the data are displayed on the columns or vice versa. In the case of row by row sequential operation, the control circuit for the rows imposes a first selection potential on the chosen row, the other rows being taken to a reference potential. For a part of the duration corresponding to the row control, a potential dependent on the data to be displayed is imposed on all the columns by the column control circuits. Therefore, all the column control circuits change state simultaneously. These simultaneous changes of state therefore produce a capacitive coupling between rows and columns which is greater the larger the difference between the control impedance and the load impedance in favor of the latter. Now, this coupling referred to as column-row-column or CRC coupling causes variations in contrast from one column to another of the screen, if it is not compensated.

Thus, various solutions have been proposed for compensating the capacitive couplings existing between the rows and the columns of a matrix screen using row or column control devices, more especially those exhibiting a high or medium output impedance. A compensation circuit of this type is described for example in French patent application No. 94 05987 filed on 17 May 1994 in the name of THOMSON-LCD and published under No. 2 720 185. In this case, an additional electrode coupled capacitively by capacitors to each of the rows of the screen is used to carry out the compensation, and an additional line also coupled capacitively to the columns of the screen which it crosses is used to detect the compensation level to be introduced. In this case, two additional electrodes are required to carry out the measurement of the imbalance due to the capacitive coupling and the compensation of this imbalance.

To remedy this drawback, French patent application No. 97 06940 filed on 5 Jun. 1997 and published under No. 2 764 424 in the name of THOMSON-LCD has proposed the use of just a single additional electrode or bus to carry out both the measurement of the imbalance and the compensation of this imbalance. In this case, use is made of a circuit for compensating for the imbalances due to the row/column capacitive coupling during the control phases, whose input and output are coupled to said additional bus. As represented in FIG. 1, the compensation circuit used consists of an operational amplifier 2, one input of which, namely the negative input 3, is linked by way of an impedance, namely the resistor R1 in the embodiment represented, to a reference voltage $V_{ref}$. This input 3 is also linked by way of a second impedance, namely the resistor R2, to the output 5 of the operational amplifier. Moreover, the second input, namely the positive input 4, is linked to the point B of connection to the additional compensation bus and it is also connected across a first capacitor C2 to the output 5 of the operational amplifier. On the other hand, the point B is connected to the compensation bus across the compensation capacitor C1 whose value is equal to the sum of the capacitors linking the additional bus or buses to each row of the matrix array. To detect the losses $V_{loss}$ with the above arrangement, when the rows are disturbed capacitively by the columns, the output 5 of the operational amplifier 2 is modified in such a way as to bring the row voltage down to a value equal to the reference voltage therefore making it possible to compensate for the imbalance with the same bus.

The above circuit is a negative-impedance compensator. It converts any current in the compensation capacitor C1 into a reverse voltage variation in this same capacitor. This type of circuit is very sensitive to the leakage currents in the row control circuits and to the currents emanating from the capacitors of the compensation bus upon the application of other screen control signals. Therefore, the circuit described above starts oscillating when the compensation voltage becomes too large.

The aim of the present invention is to remedy the above-mentioned drawbacks by proposing a novel process for compensating a capacitively disturbed circuit as well as a novel circuit for implementing the process.

BRIEF SUMMARY OF THE INVENTION

Thus, the subject of the present invention is a process for compensating for the capacitive disturbances in a display screen comprising an array of electrodes disposed matrix-wise in rows lj (j varying from 1 to m) and columns ci (i varying from 1 to n), the electrodes being linked to image-elements or pixels, a coupling capacitor being associated with each row/column crossover, a conductor plane with a reference voltage forming capacitive elements together with the image-elements and having by design a nonzero capacitance with the set of columns, a row-control circuit and a column-control circuit and at least one compensation conductor bus crossing the set of rows, said process being characterized by the following steps:

- measurement of the current flowing in the conductor plane upon the application of a voltage to at least one column,
- integration of the measured current so as to obtain a compensation voltage to be applied to at least one row by way of the compensation conductor bus coupled capacitively to the rows.

According to a preferred embodiment, the measurement of the current is carried out by a first impedance in series with the conductor plane and the integration of the current is carried out by an integrator circuit arranged in parallel with the first impedance. Preferably, the integrator circuit is constituted by an operational amplifier and a negative feedback circuit consisting of a capacitor arranged between the output terminal and one of the input terminals of the operational amplifier. According to a variant, the negative feedback circuit can consist of a capacitor and a parallel impedance, thereby limiting the gain of the integrator at high frequencies.

According to another characteristic, a second impedance is arranged in series between said input terminal of the operational amplifier and a terminal of the first impedance, this second impedance possibly being variable. A third impedance can be connected between the other terminal of the first impedance and the second input terminal of the operational amplifier.

This third impedance can also be variable.

The present invention also relates to a display screen comprising an array of electrodes disposed matrix-wise in rows Lj (j varying from 1 to m) and columns Ci (i varying from 1 to n), the electrodes being linked to image-elements or pixels, a coupling capacitor being associated with each row/column crossover, a conductor plane with a reference voltage forming capacitive elements together with the image-elements and having by design a nonzero capacitance with the set of columns, row- and column-control circuits and at least one compensation conductor bus crossing the set of rows, the conductor plane and the conductor bus being connected to a circuit for compensating for the disturbances due to the row/column capacitive coupling implementing the above process.

Preferably, the display screen is an active matrix liquid crystal screen or LCOS screen or any display screen of similar type. Moreover, the conductor plane with a reference voltage is constituted by the counter electrode of the display screen.

BRIEF DESCRIPTION OF THE SEVERAL VIEWS OF THE DRAWINGS

Other characteristics and advantages of the present invention will become apparent on reading the description of a preferred embodiment, this description being given with reference to the appended drawings in which.

DETAILED DESCRIPTION OF THE INVENTION

Figure 1:
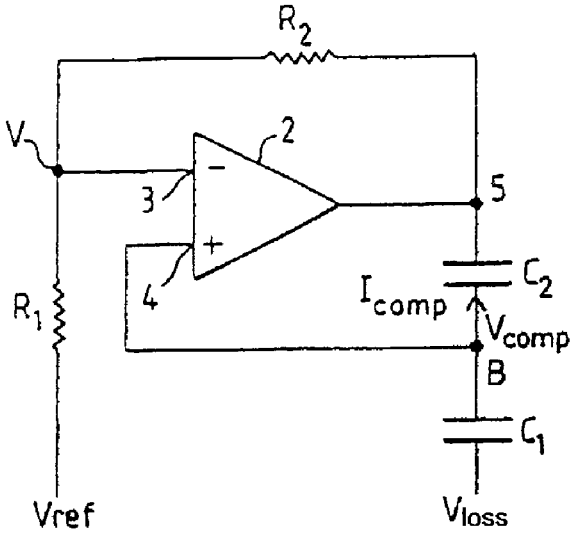
FIG. 1 already described represents a compensation circuit according to the prior art, FIG. 2 diagrammatically represents a liquid crystal display screen of the active matrix type to which the present invention may be applied.
Figure 2:
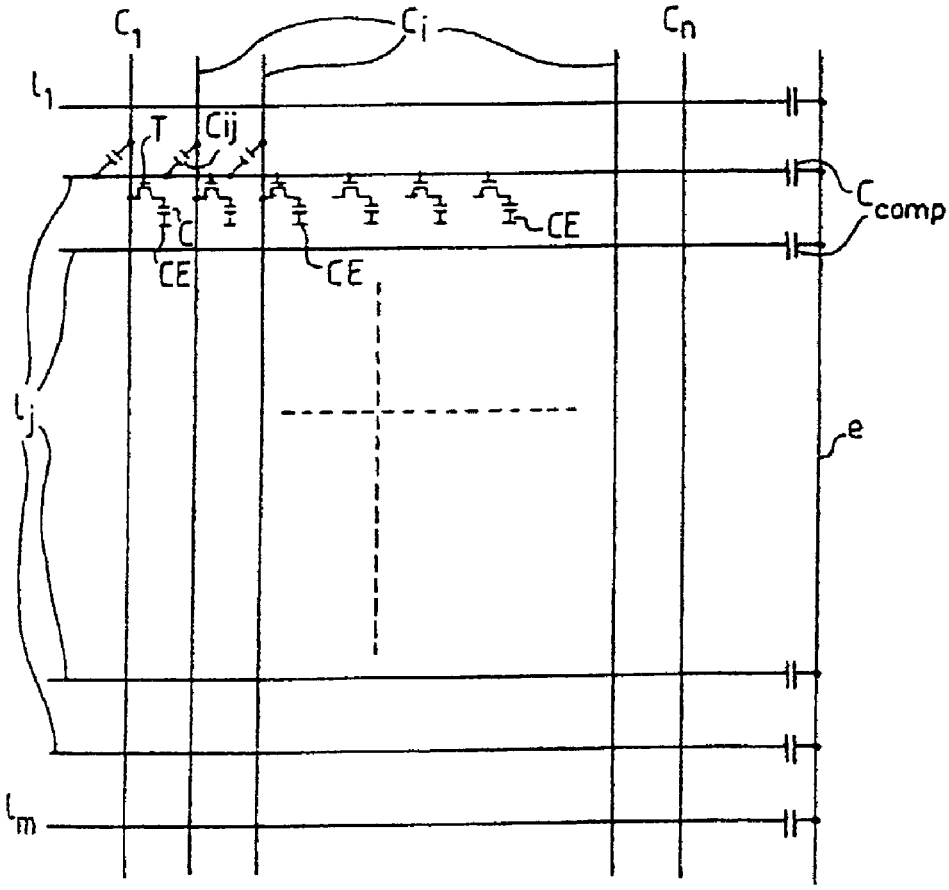

A matrix array display screen, more especially a liquid crystal screen furnished with a compensation bus making it possible to implement the present invention will be described with reference to FIG. 2. This display screen consists of a matrix array of rows lj (j varying from 1 to m) and columns ci (i varying from 1 to m) disposed perpendicularly. At the crossover of each row and of each column is a control transistor T, in general a thin film transistor or TFT which controls a pixel symbolized by a capacitor C. In the case of a liquid crystal screen, one of the electrodes of the capacitor C consists of the pixel electrode while the other electrode consists of a counter electrode CE common to all the pixels. In a known manner, the rows are connected to row control circuits (not represented) while the columns are connected to column control circuits (not represented). As explained in the introduction, when the outputs of the row control circuits are not at low impedance, there are nonnegligible capacitive couplings represented by the capacitances Cij between the rows and the columns. Hence, to remedy this drawback and as represented in FIG. 2, at least one additional bus or compensation bus e is provided. This compensation bus e is embodied parallel to the columns ci and is coupled capacitively by capacitances referenced Ccomp to each of the rows lj of the screen.

In the circuit described above, the counter electrode which constitutes the reference electrode for the liquid crystal capacitor can be regarded as a voltage reference for the display screen. Now, each column has a nonzero capacitance with the counter electrode and the column charges or discharges this capacitor with each switching. In accordance with the present invention, the variation in the voltage of the columns can therefore be deduced from the measurement of the current in the voltage reference plane, namely in the counter electrode. Specifically, the voltage switching at the level of the columns generates inrushes of current into the counter electrode and the integral of the current measured in the counter electrode is proportional to the voltage variation of the column during switching. This value may therefore be used to compensate for the disturbances due to the row/column coupling or CRC disturbances.

Figure 3:
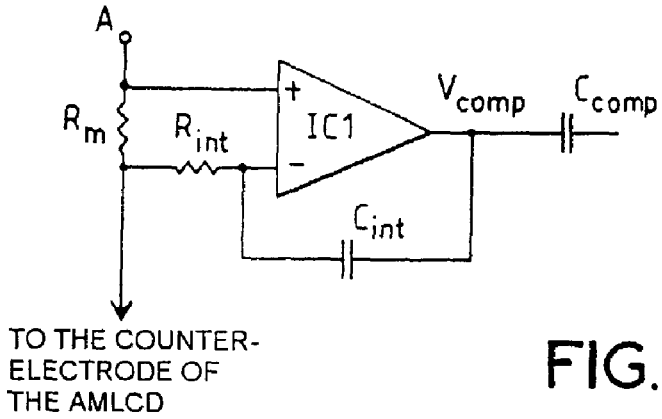
FIG. 3 represents a compensation circuit in accordance with the present invention.

A first circuit making it possible to carry out the compensation in accordance with the present invention will now be described with reference to FIG. 3. This circuit essentially comprises a means of measuring the current flowing around the counter electrode upon the application of a voltage to the columns of an LCD screen and a means making it possible to integrate the current measured in such a way as to obtain a compensation voltage to be applied to the rows by way of the compensation bus. The means for measuring the current consists of an impedance, namely the resistor Rm arranged in series with the counter electrode of the active matrix liquid crystal screen. This resistor Rm is connected, at the level of the terminal A, to the circuit for controlling the counter electrode signal which makes it possible to apply a reference voltage to the counter electrode. The integration circuit consists in a known manner of an operational amplifier IC1 whose output is connected by way of a capacitor Cint to one of the inputs, namely the—input of the amplifier IC1. On the other hand, a resistor Rint is arranged in series with the—input of the operational amplifier IC1. The resistor Rm for measuring the current flowing in the counter electrode is arranged between the + terminal of the amplifier IC1 and the terminal of the resistor Rint which is not connected to the—input of the amplifier IC1. The resistor Rm is therefore arranged in series between the circuit for controlling the counter electrode signal and the counter electrode of the liquid crystal screen. With the circuit described above, the potential difference across the terminals of the resistor Rm is proportional to the current which passes through the counter electrode. This current is integrated by the operational amplifier IC1 and the capacitor Cint and gives as output a voltage Vcomp which is proportional to the compensation voltage. This voltage Vcomp is applied to the rows of the screen by way of the compensation capacitors Ccomp. Preferably, to obtain a suitable compensation voltage, the resistor Rint is a variable resistor making it possible to adjust the gain of the integrator. According to a variant embodiment, the counter electrode can be replaced by a ground plane. In this case, the invention operates in an absolutely identical manner when the current is measured in said ground plane which then serves as reference for the storage capacitors of all the pixels if the columns have a nonzero capacitance with the ground plane.

Figure 4:
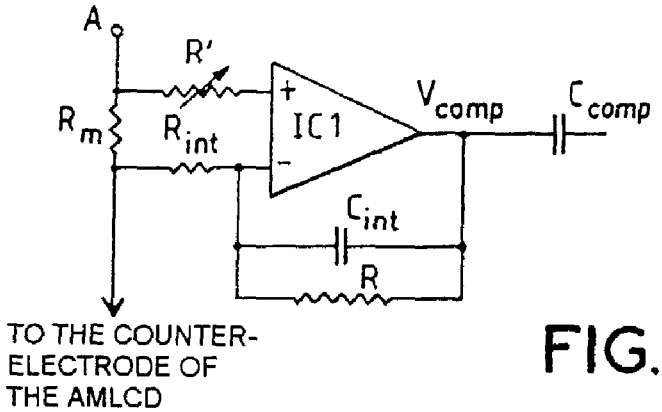
FIG. 4 represents a variant of the compensation circuit in accordance with the present invention.

Represented in FIG. 4 is a variant embodiment of the circuit. In this case, the negative feedback circuit arranged between the output and the—input of the operational amplifier is constituted by a filter formed of the capacitor Cint and of a resistor R arranged in parallel. This structure limits the gain of the integrator at high frequencies. Moreover, a resistor R', variable or otherwise, is arranged between the + terminal of the operational amplifier and the terminal A. The other elements are identical.

Figure 5:
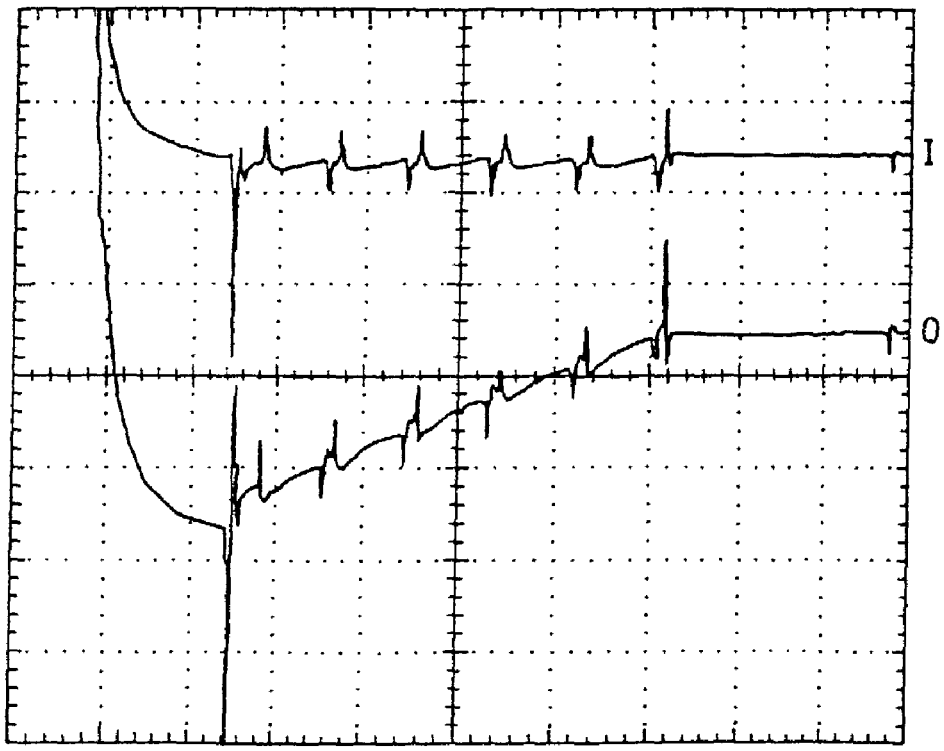
FIG. 5 represents measurements of voltage across the terminals of the measurement resistor and on the compensation bus which are performed on a XGA screen.

The circuit described above does not oscillate as represented by the curves of FIG. 5 in which the curve I represents the voltage measurement across the terminals of the resistor Rm and the curve O represents the voltage on the compensation bus as a function of time. The measurements were made on an XGA screen exhibiting a demultiplexing factor of 5, on which at the start of each row, the column voltage is precharged to a reference voltage, this explaining the spike observed in the curves.

The present invention applies not only to display screens of the type with integrated control devices, comprising in particular high-impedance row control circuits, but it can also apply to display screens with external control circuits. In this case, the measurement of the current is performed on the voltage for turning off the rows at the input of the external control circuits. The output of the operational amplifier arranged as an integrator is linked to the compensation bus "e" of FIG. 2.

It is obvious to the person skilled in the art that the present invention may be applied to all types of active matrix display screens, of the type comprising a conductor plane similar to the counter electrode of an LCD screen. It may be applied not only to active matrix liquid crystal screens of the type described above but also to LCOS screens, whatever technology is used for embodying the transistors, namely amorphous silicon, low-temperature polycrystalline silicon, high-temperature polycrystalline silicon or crystalline silicon.

What is claimed is:

1. A process for compensating for capacitive disturbances in a display screen including an array of electrodes disposed matrix-wise in rows lj, j varying from 1 to m, and columns ci, i varying from 1 to n, the array of electrodes being linked to image-elements, a coupling capacitor being associated with each row/column crossover, a conductor plane with a reference voltage forming capacitive elements together with the image-elements and having by design a nonzero capacitance with the columns, a row-control circuit and a column-control circuit and at least one compensation conductor bus crossing the rows, the process comprising:

measuring current flowing in the conductor plane upon application of a voltage to at least one column;

integrating the measured current to obtain a compensation voltage; and applying the compensation voltage to at least one of the rows via the compensation conductor bus, the compensation conductor bus being coupled capacitively to the rows, wherein the measuring the current is carried out by a first impedance in series with the conductor plane and the integrating the current is carried out by an integrator circuit arranged in parallel with the first impedance, and wherein the integrator circuit is constituted by an operational amplifier and a filter formed of a capacitor and of a resistor in parallel, and which is arranged between the output terminal and one of the input terminals of the operational amplifier.

2. A process for compensating for capacitive disturbances in a display screen including an array of electrodes disposed matrix-wise in rows lj, j varying from 1 to m, and columns ci, i varying from 1 to n, the array of electrodes being linked to image-elements, a coupling capacitor being associated with each row/column crossover, a conductor plane with a reference voltage forming capacitive elements together with the image-elements and having by design a nonzero capacitance with the columns, a row-control circuit and a column-control circuit and at least one compensation conductor bus crossing the rows, the process comprising:

measuring current flowing in the conductor plane upon application of a voltage to at least one column;

integrating the measured current to obtain a compensation voltage; and applying the compensation voltage to at least one of the rows via the compensation conductor bus, the compensation conductor bus being coupled capacitively to the rows, wherein the measuring the current is carried out by a first impedance in series with the conductor plane and the integrating the current is carried out by an integrator circuit arranged in parallel with the first impedance, and wherein the integrator circuit is constituted by an operational amplifier and a capacitor arranged between an output terminal and one of input terminals of the operational amplifier.

3. The process as claimed in claim 2, wherein a second impedance is arranged in series between the input terminal of the operational amplifier and a terminal of the first impedance.

4. The process as claimed in claim 3, wherein a third impedance is arranged in series between another input terminal of the operational amplifier and another terminal of the first impedance.

5. A process for compensating for capacitive disturbances in a display screen including an array of electrodes disposed matrix-wise in rows lj, j varying from 1 to m, and columns ci, i varying from 1 to n, the array of electrodes being linked to image-elements, a coupling capacitor being associated with each row/column crossover, a conductor plane with a reference voltage forming capacitive elements together with the image-elements and having by design a nonzero capacitance with the columns, a row-control circuit and a column-control circuit and at least one compensation conductor bus crossing the rows, the process comprising:

measuring current flowing in the conductor plane upon application of a voltage to at least one column;

integrating the measured current to obtain a compensation voltage;

applying the compensation voltage to at least one of the rows via the compensation conductor bus, the compensation conductor bus being coupled capacitively to the rows; and wherein the integrating the current is carried out by an integrator circuit arranged in parallel with a first impedance.

6. The process as claimed in claim 5, wherein the measuring the current is carried out by a first impedance in series with the conductor plane.

7. A display screen comprising:

an array of electrodes disposed matrix-wise in rows lj, j varying from 1 to m, and columns ci, i varying from 1 to n, the electrodes being linked to image-elements, a coupling capacitor being associated with each row/column crossover, a conductor plane with a reference voltage forming capacitive elements together with the image-elements and having by design a nonzero capacitance with the columns, a row-control circuit and a column-control circuit and at least one compensation conductor bus crossing the rows, wherein the conductor plane and the compensation conductor bus are connected to a circuit for compensating for disturbances due to the row/column capacitive couplings implementing the process according to claim 5.

8. The display screen as claimed in claim 7, further comprising an active matrix liquid crystal screen or LCOS screen.

9. The display screen as claimed in claim 7, wherein the conductor plane with a reference voltage is constituted by a counter electrode.

* * * * *